US006594973B1

(12) United States Patent
Alpert et al.

(10) Patent No.: US 6,594,973 B1
(45) Date of Patent: Jul. 22, 2003

(54) METHOD OF PACKAGING AND SELLING NATURAL STONE

(75) Inventors: Arnold L. Alpert, Hollywood, CA (US); Lawrence E. Coffman, Los Angeles, CA (US)

(73) Assignee: Romala Stone, Inc., Beverly Hills, CA (US)

( * ) Notice: Subject to any disclaimer, the term of this patent is extended or adjusted under 35 U.S.C. 154(b) by 0 days.

(21) Appl. No.: 09/435,151

(22) Filed: Nov. 8, 1999

(51) Int. Cl.[7] ..... B65B 63/00

(52) U.S. Cl. ..... 53/435; 53/513; 206/322; 125/9

(58) Field of Search ..... 53/435, 513; 125/9, 125/13.01; 206/322

(56) References Cited

U.S. PATENT DOCUMENTS

| | | | | | |
|---|---|---|---|---|---|
| 2,846,064 | A | * | 8/1958 | Rowe | 206/65 |
| 2,878,933 | A | * | 3/1959 | Sager | 206/79 |
| 3,586,234 | A | * | 6/1971 | Nathan et al. | 229/40 |
| RE28,460 | E | * | 7/1975 | Rous | 206/424 |
| 4,784,170 | A | * | 11/1988 | Romanelli et al. | 134/113 |
| 4,951,483 | A | * | 8/1990 | van Olphen | 68/213 |
| 4,962,967 | A | * | 10/1990 | Hinkle | 299/41 |
| 5,208,086 | A | * | 5/1993 | Owens | 428/47 |
| 5,253,932 | A | * | 10/1993 | Nesovic | 312/140.3 |
| 5,274,963 | A | * | 1/1994 | Tsur | 51/283 |
| 5,425,475 | A | * | 6/1995 | Clark | 222/103 |
| 5,452,666 | A | * | 9/1995 | Peters | 108/27 |
| 5,522,502 | A | * | 6/1996 | Orr et al. | 206/320 |
| 5,579,991 | A | * | 12/1996 | Strasevicz et al. | 229/164 |
| 5,640,947 | A | * | 6/1997 | Shute | 126/211 |
| 5,702,033 | A | * | 12/1997 | Beaver | 222/94 |
| 5,735,001 | A | * | 4/1998 | Bitsche | 4/631 |
| 6,006,735 | A | * | 12/1999 | Schlough et al. | 125/13.01 |
| 6,258,190 | B1 | * | 7/2001 | Sciarrino et al. | 156/71 |

FOREIGN PATENT DOCUMENTS

| | | | |
|---|---|---|---|
| JP | 09194575 | * | 7/1997 |

* cited by examiner

*Primary Examiner*—Stephen F. Gerrity
*Assistant Examiner*—Thanh Truong
(74) *Attorney, Agent, or Firm*—Ladas & Parry

(57) ABSTRACT

This invention comprises a unique method for the sale of natural stone, special packaging for the stone and a method of doing business to make the stone available in high volume stores to the average consumer. The method comprises pre-fabricating the stone into slabs at or near the location where it is quarried, into sizes and shapes which are common, and often standard, in household bathrooms and kitchens. The stone slabs may, or may not, include cut-outs for sinks and faucets of various standard size. The pre-fabricated stone is then packaged in a box or carton which is designed to specially protect the stone, especially at the corners where most damage occurs, and shipping the packages to high volume, do-it-yourself consumer outlets.

14 Claims, 6 Drawing Sheets

FIG. 5
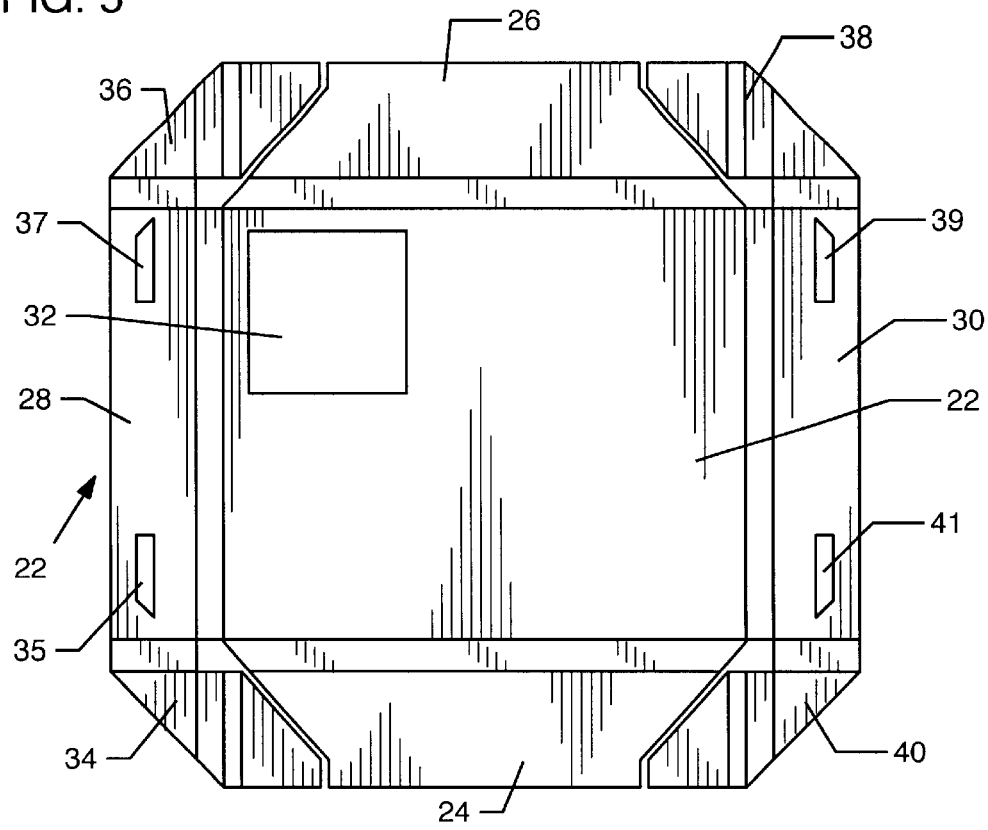
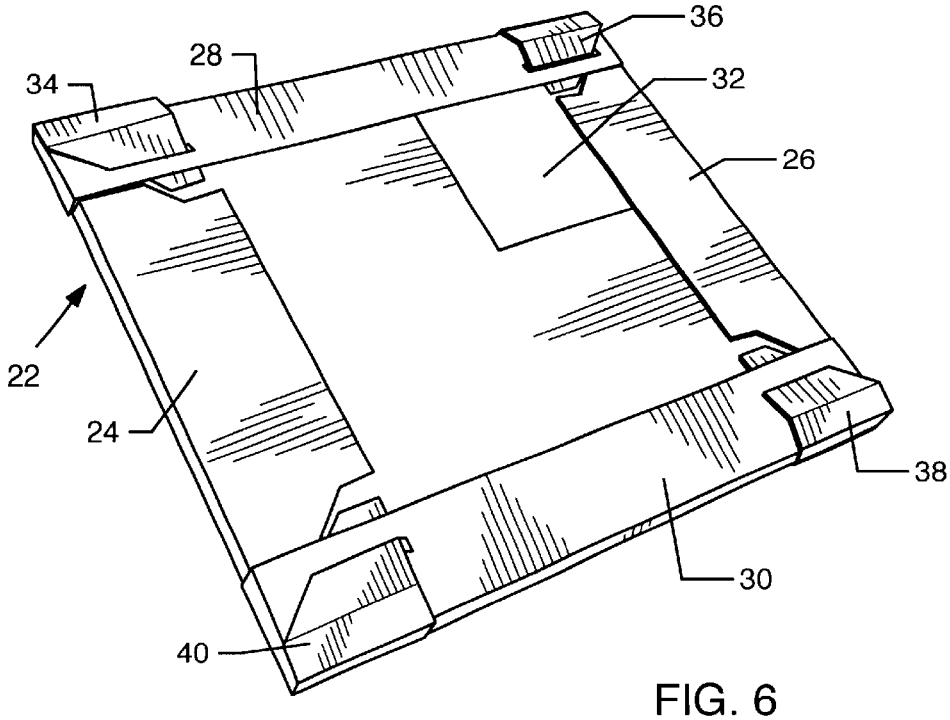
FIG. 6

METHOD OF PACKAGING AND SELLING NATURAL STONE

BACKGROUND OF THE INVENTION

Countertops for bathrooms, kitchens and the like are an important part of any home. These countertops can be made from many different materials such as stone, including marble and granite, tile, or formica, as well as wood and metal. Natural stone, marble or granite is the most desired and the most expensive of these materials. As a result there have been produced man-made materials made to look like stone which are derived of mixtures of resins or cement with the addition of stone chips. These include terrazzo, agglomerates and conglomerates, and cultured or faux marble.

Stone is a natural solid formation of many minerals. There are hundreds of types of stone that have been quarried through the centuries. Quarries are located all over the world. A majority of natural stone comes from Italy, Spain, Turkey, United States, Mexico, China, Taiwan, India, Greece, Canada, France and Brazil. The more familiar natural stone types that are used in construction today are identified in four categories: sedimentary, metamorphic, igneous and man-made.

Sedimentary stone came from organic elements such as glaciers, rivers, wind, oceans and plants. Tiny sedimentary pieces broke off from these elements and accumulated to form rock beds. They were bonded through millions of years of heat and pressure.

Metamorphic stone originates from a natural change from one type of stone to another type through the mixture of heat, pressure, and minerals. The change may be a development of crystalline formation, a texture change, or a color change.

Marble is a recrystallized limestone that formed when the limestone softened from heat and pressure and recrystallized into marble where mineral changes occurred. The main consistency is calcium and dolomite. Marble ranges in many colors and is usually heavily veined and shows lots of grains. Its hardness rates from 2.5 to 5 on the Measure of Hardness (MOH) Scale.

Marble is classified into three categories, as classified by Stone World, an industry magazine:

1. Dolomite: If it has more than 40% magnesium carbonate.
2. Magnesian: If it has between 5% and 40% magnesium carbonate.
3. Calcite: If it has less than 5% magnesium carbonate.

Slate is a fine-grained metamorphic stone that formed from clay, sedimentary rock shale, and sometimes quartz. Slate is very thin and can break easily. It usually has a black, grey or green color.

Serpentine is identified by its marks, which look like the skin of a serpent. Most popular colors are green and brown. Hardness rates from 2.5 to 4 on the MOH scale. Serpentine does not always react well to recrystalization or diamond polishing.

Igneous stones are mainly formed through volcanic material such a magma. Underneath the Earth's surface, liquid magma cooled and solidified. Mineral gases and liquids penetrated into the stone and created new crystalline formations with various colors.

Granite is primarily made of Quartz (35%), Feldspar (45%), and Potassium. It usually has darker colors and contains very little calcite, if any. Granite has a heavy crystalline and granular appearance with mineral grains. It is very hard material and easier to maintain than marble, yet it is still porous and will stain. There are different types of granite depending on the percentage mix of quartz, mica and feldspar. Black granite is known as an Anorthosite. It contains very little quartz and feldspar and has a different composition than true granite.

Man-made stone is derived of mixtures of resins or cement with the addition of stone chips. These include terrazzo, agglomerates and conglomerates, and cultured or faux marble.

Natural stone is far more expensive than man-made and is in great demand by those who can afford it. Until now, no method has been developed to sell natural stone at prices that are reasonable to the average consumer.

OBJECTS OF THE INVENTION

It is an object of this invention to provide an improved method to package and sell natural stone through high volume stores, such as Home Depot, so that it is available to the average consumer, particularly the do-it-yourself homeowner.

It is a further object of this invention to provide unique packaging for natural stone which protects the stone, so that it can be sold in high volume stores, yet have it well protected from damage.

A further object of the invention is to provide a method of selling natural stone to the consumer at prices lower than ever before possible, making it available to the average consumer.

SUMMARY OF THE INVENTION

This invention comprises a unique method for the sale of natural stone which includes special packaging and a method of doing business to make the stone available in high volume stores to the average consumer. The method comprises the special packaging of pre-fabricated pieces of stone, such as granite or marble, in boxes which protect the stone from damage in the shipping, handling and sale of the stone, while providing the consumer with a way to see and touch the stone, which is highly desirable, so that the consumer may choose the color and texture of the stone which he or she desires.

The method comprises pre-fabricating the stone at or near the location where it is quarried, into sizes and shapes which are common, and often standard, in household bathrooms and kitchens. This may, or may not, include cut-outs for sinks of various standard size. The pre-fabricated stone is then packaged in a box or carton which is designed to specially protect the stone, especially at the corners where most damage occurs, and shipping the packages to high volume stores, such as Home Depot and the like, for high volume sales. This method brings down the price of the stone to the consumer to very attractive levels, because the cutting of stone today is done by specially trained persons on a custom basis which is very expensive.

Genuine stone slabs, used for countertops or table tops, made of natural stone such as granite, are considered a very high cost luxury item that are only affordable by the affluent, and always custom made to order. Never before has natural stone (granite, marble, etc.) been prefabricated and packaged to allow it to be sold in retail outlets. Applicants' invention allows the consumer to buy these stone countertops off the shelf.

Applicants have created an assembly line approach to a product that until now has solely been considered "a custom-made-to-order product," that customers would have to wait 6–8 weeks, on average, to have made. Applicants' slabs are designed for the "do-it-yourself" home improvement market. The slabs can be installed easily by the lay person in less than one hour. The product comes with instructions in three languages on how to assemble and install.

Applicants have developed the technology for attaching an undermount sink using an industrial strength epoxy, which is included in the package. This has made it a truly "do-it-yourself" product. In the past, metal clips were needed to hold the sink in place and it was very difficult to install and could be temporary in nature because clips can loosen up and pull out. Sinks normally would need a professional to install, using existing methods.

The unique packaging system developed by Applicants allows for shipping to stores and placement into inventory, easily displayed on shelves, and transported home by customers without breaking, chipping or scratching. Installation has been made easily accomplished by the "do-it-yourself" customer.

Counters for bathrooms and kitchens made of man-made materials are now sold in prefabricated slabs, but no one has ever sold natural stone in this manner, due to the problems with packaging and the difficulty with cutting it properly. The method will be further explained in more detail by reference to the following drawings.

BRIEF DESCRIPTION OF THE DRAWINGS

FIG. 5 is a top plan view of the inner container, opened out;

FIG. 6 is a perspective view of the inner container closed;

DETAILED DESCRIPTION OF THE INVENTION

Figure 1:
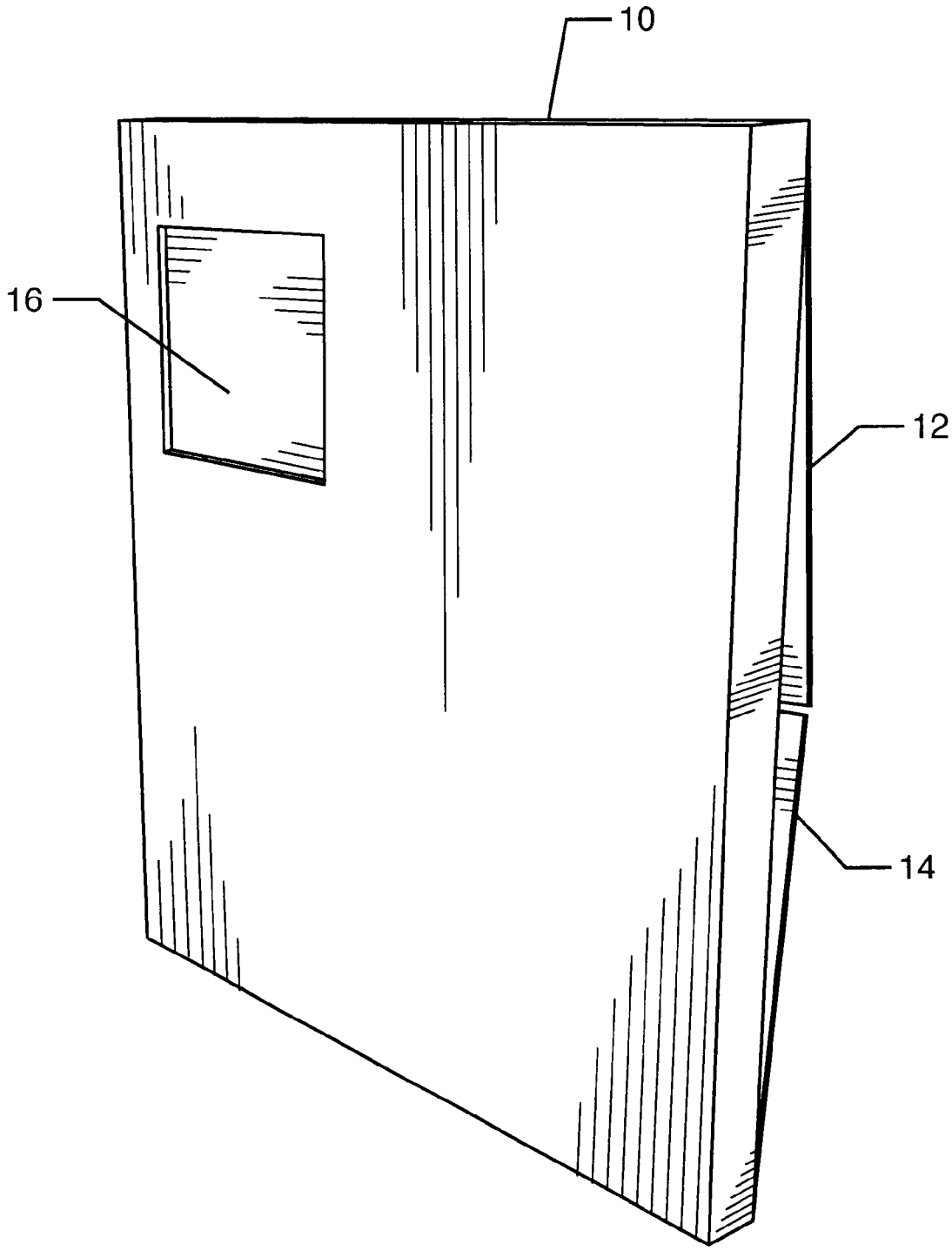
FIG. 1 is a perspective view of the outer container of this invention.
Figure 2:
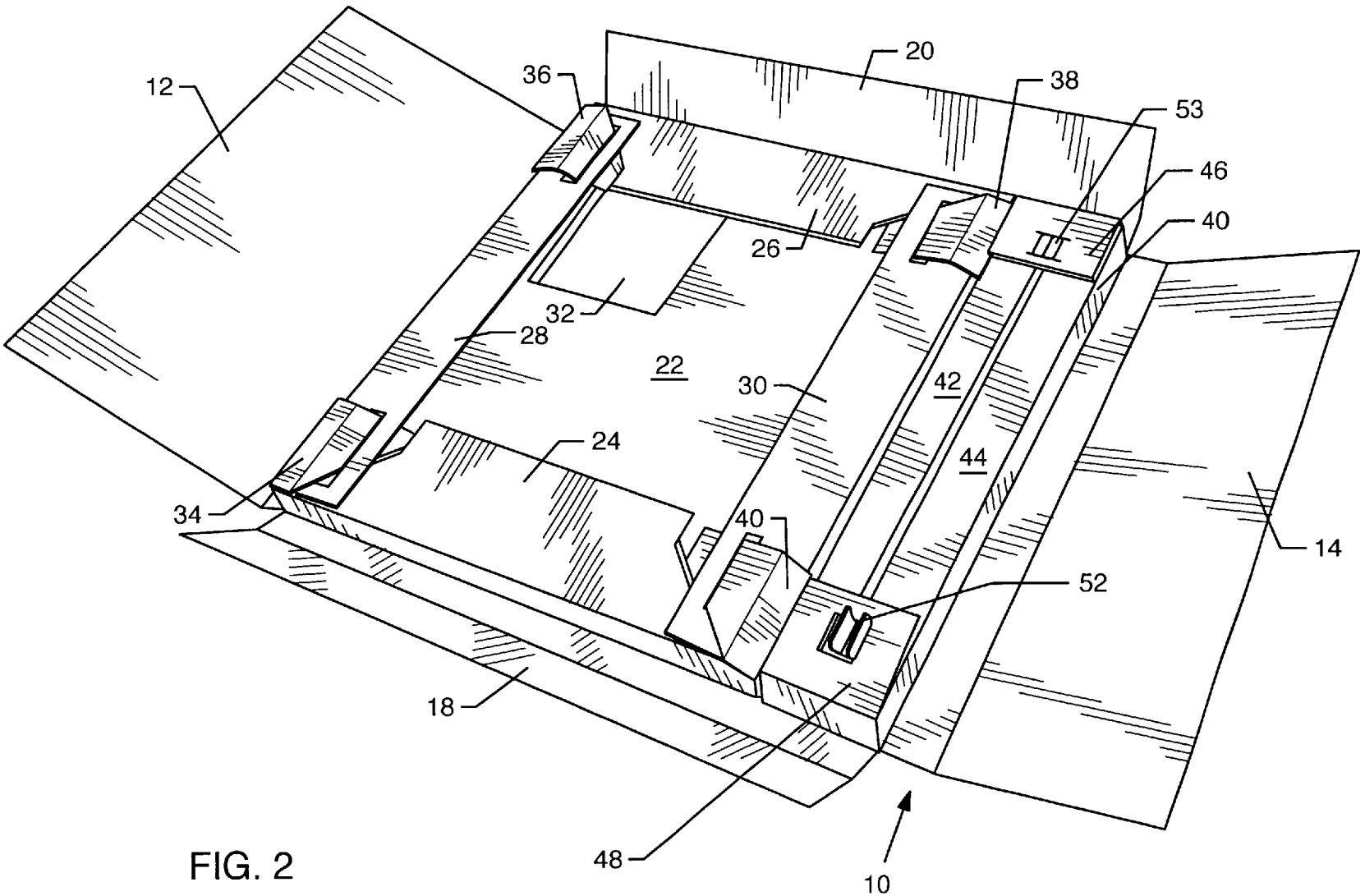
FIG. 2 is a perspective view of the total package, opened out.

Referring now to the drawings there is shown the outer box or carton 10 for packaging of the natural stone for sale. Outer box 10 has closing panels 12 and 14 and an opening or window 16. FIG. 2 shows the packaging completely put together but in the open state. Outer box 10 also has side closing panels 18 and 20. Inside of outer box 10 is an inner box 22, shown in more detail in FIGS. 5 and 6.

Inner box 22 has four closing panels 24, 26, 28, and 30. Inner box 22 also has a cut-out or window 32 which matches cut-out 16 of outer box 10. The purpose of cut-outs 16 and 32 is to allow the customer to both see and feel the stone which is packaged inside, in order to give the customer the ability to experience the texture and the color of the stone, which is a major factor in determining which piece of stone to purchase. Experience has taught that customers will rarely purchase stone as counters for bathrooms, kitchens or tables unless they can both see and touch the stone itself.

Inner box 22 has four folding corners 34, 36, 38, and 40. The manner in which these four corners fold will be explained in detail in reference to FIGS. 7–10. The purpose of the four folding corners 34, 36, 38, and 40 is to protect the corners of the stone slab from damage, such as chipping or breaking, a common problem which has made the sale of prefabricated stone slabs unmanageable until Applicants' packaging.

Figure 3:
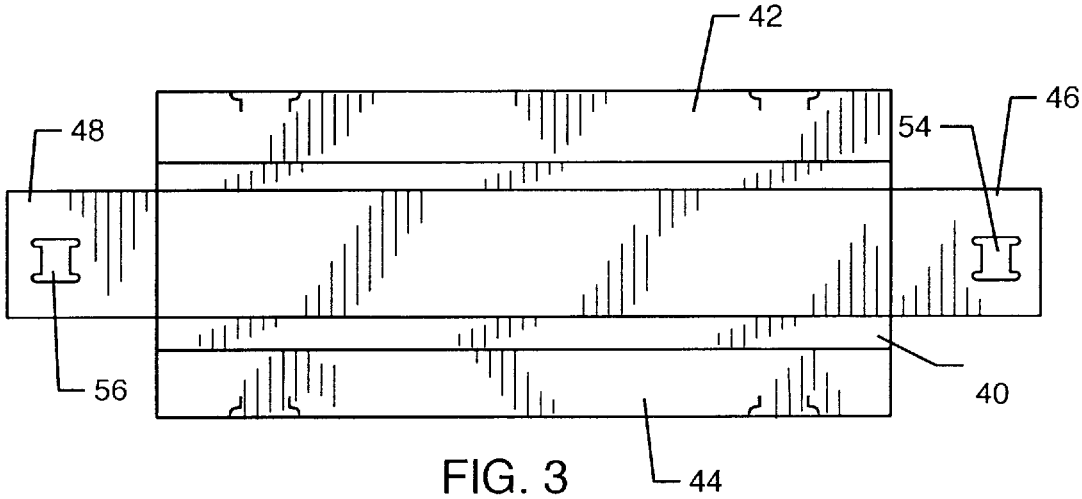
FIG. 3 is a top plan view of the insert opened out.
Figure 4:
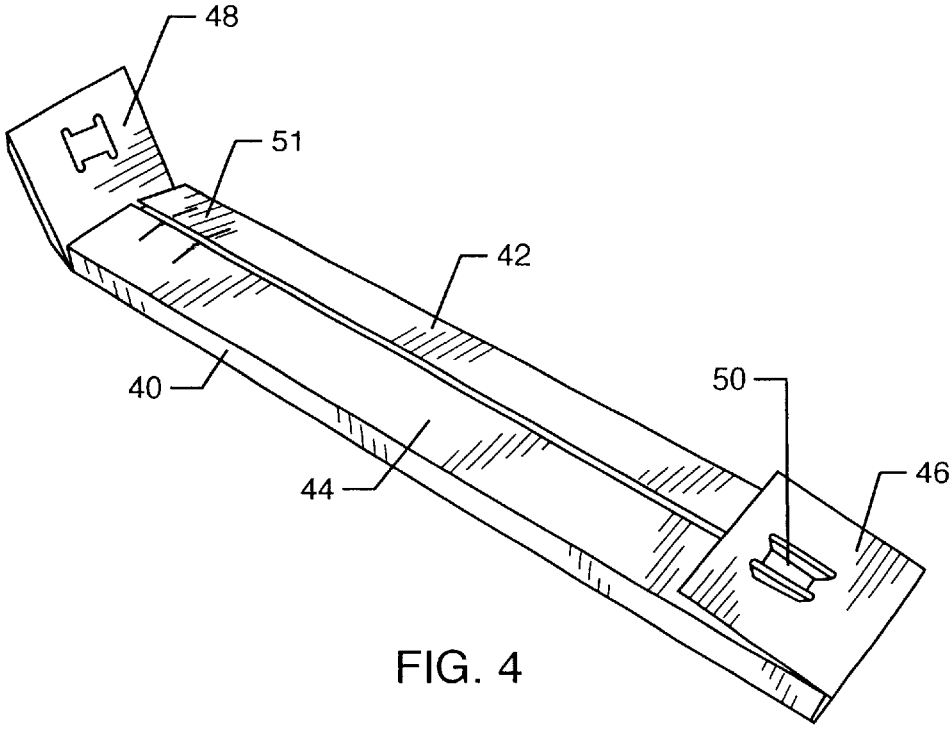
FIG. 4 is a perspective view of the insert assembled.
Figure 7:
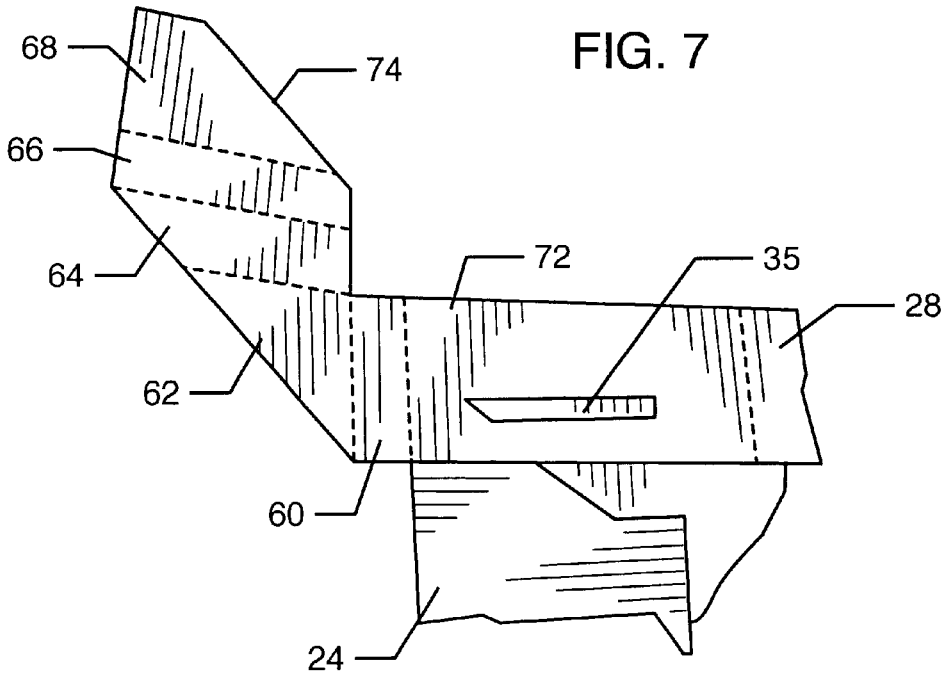
FIG. 7 is a perspective view of the first fold of one corner of the inner container.

Inside of outer box 10 is also backsplash box 40 which is long narrow box, shown in more detail in FIGS. 3 and 4. Box 40 fits alongside inner box 22 and holds a long narrow piece of stone matching the stone of the counter in box 22. The backsplash is a standard piece which fits behind any bathroom or kitchen counter to protect against water hitting the wall behind the counter.

Referring to FIGS. 3 and 4 there is shown the narrow backsplash box 40 with two long folding panels 42, 44 to close and cover the stone backsplash piece. Two small panels 46, 48 fold lengthwise, over the top of panels 42, 44. Panels 46, 48 have slots 54, 56 which are adapted to receive a pair of tabs 50, 51 which pull up and lock into slots 54, 56 to seal box 40 so that the stone backsplash is held firmly and safely in box 40. As shown in FIG. 2, box 40 lays flat and adjacent to box 22 inside of outer box 10 to complete the package.

FIGS. 5 and 6 show inner box 22 in the unfolded state (FIG. 5) and the fully folded state (FIG. 6). Folding corners 34, 36, 38, 40 fold over panels 28 and 30 so that they fit through slots 35, 37, 39 and 41 to close inner box 22 and lock it around the stone slab held inside.

Figure 8:
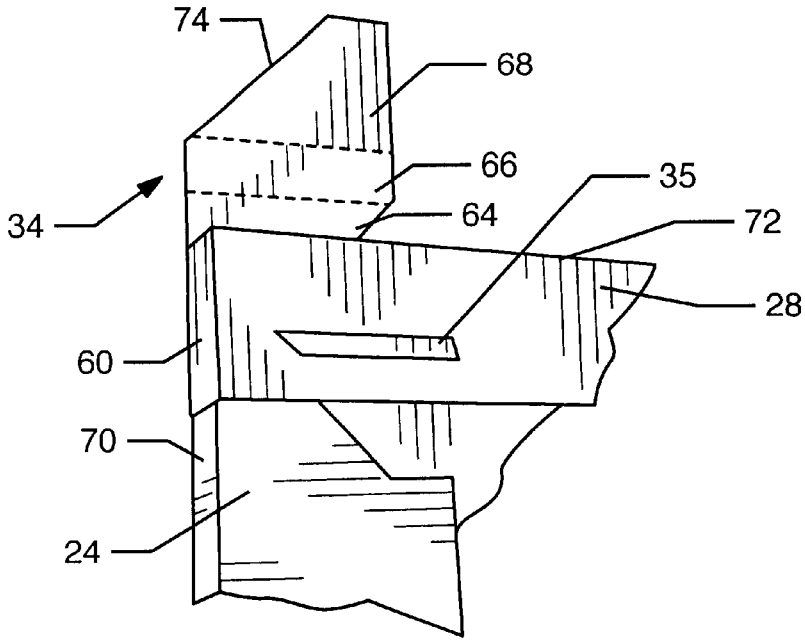
FIG. 8 is a perspective view of the second fold of the corner.
Figure 9:
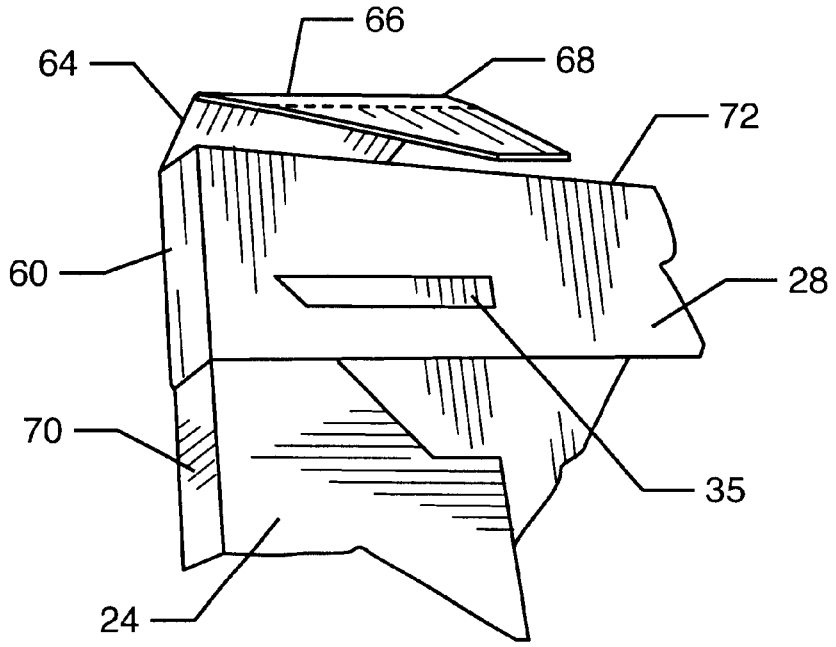
FIG. 9 is a perspective view of the third fold of the corner.
Figure 10:
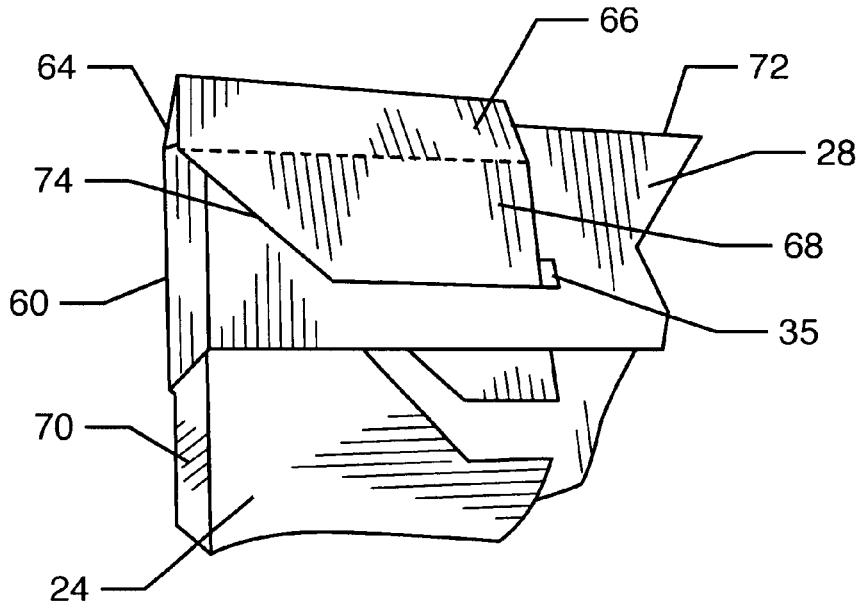
FIG. 10 is a perspective view of the corner fully folded.

FIGS. 7–10 show how the folding corners 34, 36, 38 and 40 function. Each of the folding corners 34, 36, 38, and 40 has five sections, as shown at 60, 62, 64, 66, and 68, all adapted to fold along the dotted lines depicted, which are fold lines built into each corner. The first section 60 folds around the side of 70 of inner box 22. It folds towards the front of box 22, the side with cut-out 32. The second section 62 folds around the front of box 22 which folds to bring sections 64, 66, and 68 facing the rear of box 22, as shown in FIG. 8. Section 64 then folds over the top edge 72 of box 22, as shown in FIG. 9.

Finally section 66 bends allowing closing flap 68 to be inserted into slot 35 in which it slides, aided by angle cut 74. Each of the four corners is assembled in this way, as best shown in FIG. 6, which gives a very secure packaging to the stone slab contained within inner box 22, with particular protection at the corners of the stone slab which are most prone to damage.

This packaging allows the assembly line cutting of the natural stone at, or near the site of the quarry, into standard sized slabs. These slabs can be solid, if a solid countertop or tabletop is desired, or sections can be cut out to receive standard sized sinks and faucets. The slabs can then be packaged in the unique packaging above described and safely shipped in large numbers to retail sales outlets, to be sold as prefabricated natural stone slabs, in large hardware outlets or do-it-yourself type stores. The splashguard piece is also cut from the same stone to match the countertop piece and all are packaged as described.

Packaged with the slabs is a plastic container of epoxy to be used by the do-it-yourselfer to install a sink in the countertop. The epoxy comprises two separate liquid chemicals which, when mixed together, form an epoxy glue strong enough to hold the sink in place under the stone countertop. This epoxy is sold commercially, such as "EPOWELD" a registered trademark of Hardman, a Division of Harcros Chemicals, Incorporated.

Applicants, use a unique container for the two liquid components, which is particularly applicable for use with Applicants' packaging. The two liquids are placed in a single plastic container with an external plastic divider holding the two liquids apart. To use the epoxy the user slides the divider off of the plastic container which allows the two liquids to mix and the user kneads the plastic package until the two liquids are well mixed. The epoxy glue is now ready to use. The user then cuts a corner off of the plastic container and applies the epoxy to the undersurface of the stone slab, after marking the location of the sink, which will be attached under the stone countertop, at the prefabricated hole cut to accommodate it. Thus, the do-it-yourselfer can put the slab in place on a base in the bathroom or kitchen and attach the sink using the epoxy. This is all accomplished in a minimum amount of time since everything is precut to a standard size and all elements are provided in the packaging.

The cutting, packaging and sale of natural stone, such as marble and granite, in this way, allows, for the first time, the purchase and installation of natural stone, by the do-it-yourself consumer.

Other examples and applications of the invention exist, each differing from the other in matters of detail only. The invention is to be considered limited only by the following claims.

We claim:

1. A method for providing a pre cut non man made, non custom ordered stone top to enable assembly line production and sale of the top at a price affordable to an average consumer, the method comprising the steps of:

pre cutting non man made stone into the pre cut top suitable for installation by the average consumer, wherein the precut top defines cut outs to accommodate at least one sink and/or faucet;

packaging the precut top for protecting the pre cut top from breakage and scratching;

packaging fastening means with the precut top; and shipping a plurality of the packaged precut tops to a retailer for sale to and installation by the average consumer.

2. The method of claim 1 wherein the packaging defines a cut out which allows a person to see and touch the pre cut top.

3. The method of claim 1 wherein the step of packaging further comprises including instructions for installation of the pre cut top.

4. The method of claim 1 wherein the step of packaging further comprises packaging a back splash with the pre cut top.

5. The method of claim 1 wherein the packaging defines a portion that allows a person to at least see the pre cut top.

6. The method of claim 1 wherein the fastening means is epoxy.

7. The method of claim 1 wherein the pre cut top is cut into standard sizes.

8. The method of claim 1 wherein the average consumer has not pre ordered the size of the pre cut top.

9. A method for providing a pre cut non man made stone top which can be installed by an average consumer and is not custom ordered by the average consumer, the method enabling assembly line production of the top and sale of the top at a price affordable to the average consumer, the method comprising the steps of:

pre cutting non man made stone into the pre cut top, wherein the pre cut top defines at least one cut out to accommodate at least one of a sink or a faucet;

packaging the pre cut top for protecting the pre cut top from breakage and scratching;

packaging fastening means with the pre cut top; and shipping a plurality of the packaged pre cut tops to a retailer for sale to the average consumer wherein the packaged pre cut top can be installed by the average consumer.

10. The method of claim 9 wherein the packaging defines a portion that allows a person to at least see the pre cut top.

11. The method of claim 9 wherein the fastening means is an adhesive.

12. The method of claim 9 wherein the step of packaging further comprises including instructions for installation of the pre cut top.

13. The method of claim 9 wherein the step of packaging further comprises packaging a back splash with the pre cut top.

14. The method of claim 9 wherein the pre cut top is cut into standard sizes.

* * * * *